US005947583A

United States Patent [19]

Castano

[11] Patent Number: 5,947,583

[45] Date of Patent: Sep. 7, 1999

[54] ILLUMINATING CUE STICK RACK

[76] Inventor: Guillermo Castano, 86-35 Queens Blvd., Apt 3C Elmhurst, New York, N.Y. 11373

[21] Appl. No.: 08/998,821

[22] Filed: Dec. 29, 1997

[51] Int. Cl.[6] ..... A47B 23/06; A47F 7/00

[52] U.S. Cl. ..... 362/132; 362/253; 362/234; 211/68; D6/552

[58] Field of Search ..... D6/552; 211/68; 362/127, 132, 133, 134, 234, 249, 251, 253

[56] References Cited

U.S. PATENT DOCUMENTS

| | | | |
|---|---|---|---|
| D. 46,600 | 10/1914 | Maher | D6/552 |
| D. 154,103 | 6/1949 | Deskey | D6/552 |
| D. 154,104 | 6/1949 | Deskey | D6/552 |
| D. 154,105 | 6/1949 | Deskey | D6/552 |
| D. 168,328 | 12/1952 | Black | D6/552 |
| D. 222,366 | 10/1971 | Berger | D6/552 |
| D. 272,787 | 2/1984 | Rumbaugh | D6/552 |
| 824,386 | 6/1906 | Sevigny | 211/68 |
| 1,047,339 | 12/1912 | Treiber | 211/68 |
| 1,478,032 | 12/1923 | Hine | 211/68 |
| 1,503,120 | 7/1924 | Drost | 211/68 |
| 1,630,105 | 5/1927 | Bernard | 362/127 |
| 1,874,245 | 8/1932 | Corrigan | 362/133 |
| 3,146,889 | 9/1964 | Franco | 211/68 |
| 3,865,248 | 2/1975 | Donovan et al. | 362/132 |
| 4,029,313 | 6/1977 | Angulo | 362/225 |

FOREIGN PATENT DOCUMENTS

| | | |
|---|---|---|
| 49112 | 10/1889 | Germany . |
| 282220 | 12/1927 | United Kingdom . |

*Primary Examiner*—Alan Cariaso
*Attorney, Agent, or Firm*—Richard C. Litman

[57] ABSTRACT

An illuminating cue stick rack made up of a rack frame and a lighting system built into or attached onto the rack frame. The lighting system is electrically connectable to a power supply such as a wall outlet and includes provision for selective illumination by a customer to request customer assistance.

9 Claims, 3 Drawing Sheets

ILLUMINATING CUE STICK RACK

BACKGROUND OF THE INVENTION

1. Field of the Invention

The present invention relates to racks for holding cue sticks, and more specifically to an illuminating cue stick rack which a customer may illuminate to call a waitress or attendant for service.

2. Description of Related Art

Cue stick racks are well known. They are commonly found at pool-halls and other establishments which have billiard tables. A cue stick rack is typically constructed to form a simple frame. The frame generally comprises a lower horizontal base, an upper horizontal shelf, and a pair of vertical side supports which are both attached to the base and the shelf. Preferably, the frame further includes means for securing the rack to a wall. The top surface of the lower base has a plurality of recesses, each recess being sized to support the butt end of a cue stick. The upper shelf has a plurality of holes bored vertically therethrough. Each hole is sized to pass the cue end of a cue stick therethrough. The pair of side supports positionally support the upper shelf above the lower base to position the holes of the upper shelf in relative alignment with the recesses of the lower base so that the cue sticks may be stored by passing the cue ends through the holes of the upper shelf and resting the butt ends in the recesses of the lower shelf. In this manner, cue stick racks can hold a wide array of differently sized or weighted cue sticks for ready use by a customer of the establishment.

Many designs and modifications have been proposed for pool stick racks. Examples of inventions related to this art include U.S. Design Pat. No. 46,600 issued October 1914 to Maher (Design for a Billiard-Cue Rack); U.S. Design Pat. Nos. D154,103, D154,104, and D154,105 issued September 1947 to Deskey (Rack or the Like for Billiard Cues); U.S. Design Pat. No. D222,366 issued October 1971 to Berger (Billiard Cue Rack); U.S. Design Pat. No. D272,787 issued February 1984 to Rumbaugh (Bracket for Mounting on a wall for Supporting the Butt Ends of Vertically Oriented Fishing Rods); U.S. Pat. No. 824,386 issued June 1906 to Sevigny (Cue Rack); U.S. Pat. No. 1,047,339 issued December 1912 to Treiber (Cue Rack); U.S. Pat. No. 1,503,120 issued July 1924 to Drost (Cue Rack); U.S. Pat. No. 3,146,889 issued September 1964 to Franco (Billiard Cue Rack); German Pat. No. 49,112 issued October 1889 to Meurer (Neuerung an Gestellen zum Aufhängen von Billardstöcken); and U.K. Pat. No. 282,220 issued December 1927 to Lamb (New and Improved Cue Rack which can be Locked).

While all of these disclosed devices accomplish various utility or design functions, none suggest adding a lighting system to the cue stick rack, either for decorative or utilitarian purposes. Thus, none of the above inventions and patents, taken either singly or in combination, is seen to describe the instant invention as claimed.

SUMMARY OF THE INVENTION

The present invention is a cue stick rack which has a lighting system built into or attached onto the rack frame. The rack frame itself may be constructed of various materials, including wood, ivory, metal, or a combination thereof. The lighting system may include various lighting means including, but not limited to, incandescent or fluorescent light bulbs, neon tubes, or fiber optic lights. The lights, which may be disposed on various surfaces of the rack frame, are electrically wired together for connection to a power supply such as a wall outlet or a battery. For cue stick racks which are mounted on a wall, it is preferable for the lights to be disposed on front surfaces of the cue stick rack frame so that the lights will be prominently seen from various parts of the room.

As an alternative to mounting the lights upon the frame, the lighting system may also be built into the frame, so the frame member illuminates. For example, portions of the frame may be constructed of neon tubes or of a translucent material, such as acrylic, which contains lights therein. One highly preferable embodiment of this alternative includes using vertical side supports which have lights built thereinto. In this case, the side supports would serve both functions of providing structural support and also illumination. Moreover, the side supports can be formed in a decorative design, such as oversized cue sticks. The side supports may also include further decorative features, such as decorative spiral loops. Of course, these decorative portions of the frame may or may not be illuminable.

The cue stick rack lights may be turned on by plugging an electric cord into a standard wall socket. However, it is preferable if the rack lighting system additionally includes an electric switch or service button so that the lights may be selectively turned on or off. Particularly, the rack lighting system may be turned on by the customer to signal or attract the attention of the establishment's personnel. This is especially useful in large establishments which play loud music.

Illumination of the rack lighting system may be used to indicate a wide range of meanings. For example, the lighting system could be used to indicate that the particular pool table is occupied, or when a customer wishes to request food/beverage service at the pool table. It could also be used to request other service, such as the assistance of an attendant, manager or bouncer. Additionally, the lighting system may be permanently illuminated to provide additional lighting or for purely decorative purposes.

In another embodiment, the illuminating cue stick rack may be constructed to only serve the illuminating and signalling function. In this embodiment, mock cue sticks are permanently secured for storage within the rack. These permanently stored cue sticks also may or may not possess illuminating portions in electrical connection with the lighting system. This embodiment may be constructed in a full-scale size or in a reduced size for placement in smaller areas, such as above tables or in windows. To fit into these smaller areas, the miniature scale version should preferably have a height of approximately 16 inches.

Accordingly, it is a principal object of the invention to provide an illuminating cue stick rack.

It is another object of the invention to provide an illuminating cue stick rack which may be selectively turned (on or off by a customer to signal the need for assistance.

It is a further object of the invention to provide an illuminating cue stick rack which is aesthetically pleasing.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
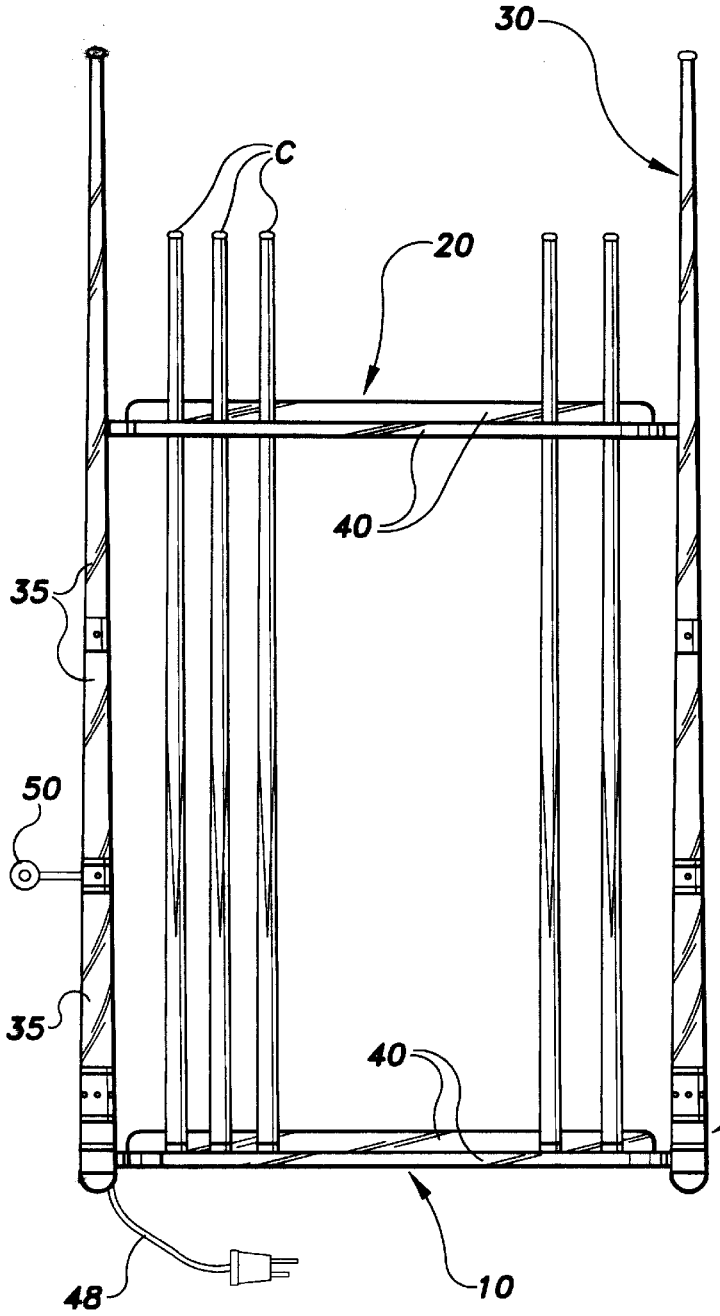
FIG. 1 is a front view of the illuminating cue stick rack according to the present invention holding a plurality of cue sticks.
Figure 2:
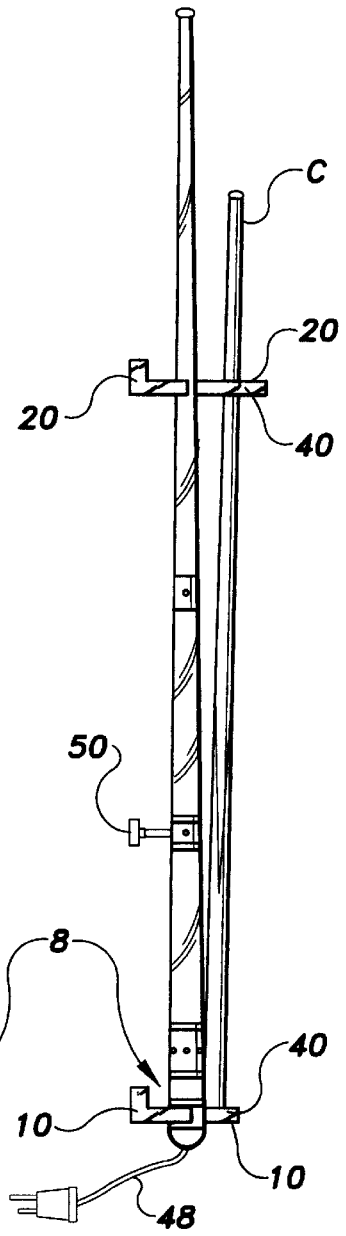
FIG. 2 is a side view of the illuminating cue stick rack.

The present invention is directed towards an illuminating cue stick rack. FIG. 1, FIG. 2, FIG. 5, and FIG. 6 depict the front and side views of two embodiments of the illuminating cue stick rack 8 according to the present invention supporting a plurality of cue sticks C. The cue stick rack 8 includes a frame which generally comprises a lower base 10, an upper shelf 20 and a pair of side supports 30. The side supports 30 possess translucent portions 35 and are decoratively configured in the design of oversized cue sticks. The side supports are attached to both the lower base 10 and the upper shelf 20 for positionally supporting the upper shelf 20 above the lower base 10. The frame also includes means for securing the cue stick rack to the wall (not shown). A lighting system includes lights 40 disposed on the front surfaces of the lower base 10 and the upper shelf 20. The lighting system also includes lights 40 built into the translucent portions 35 of the side supports 30.

The lights 40 are electrically interconnected (not shown) and wired to an electric cord 48 which is capable of being plugged into a conventional electrical outlet. A service button 50 is electrically wired to the lighting system to allow a customer to selectively illuminate the cue stick rack 8.

Figure 3:
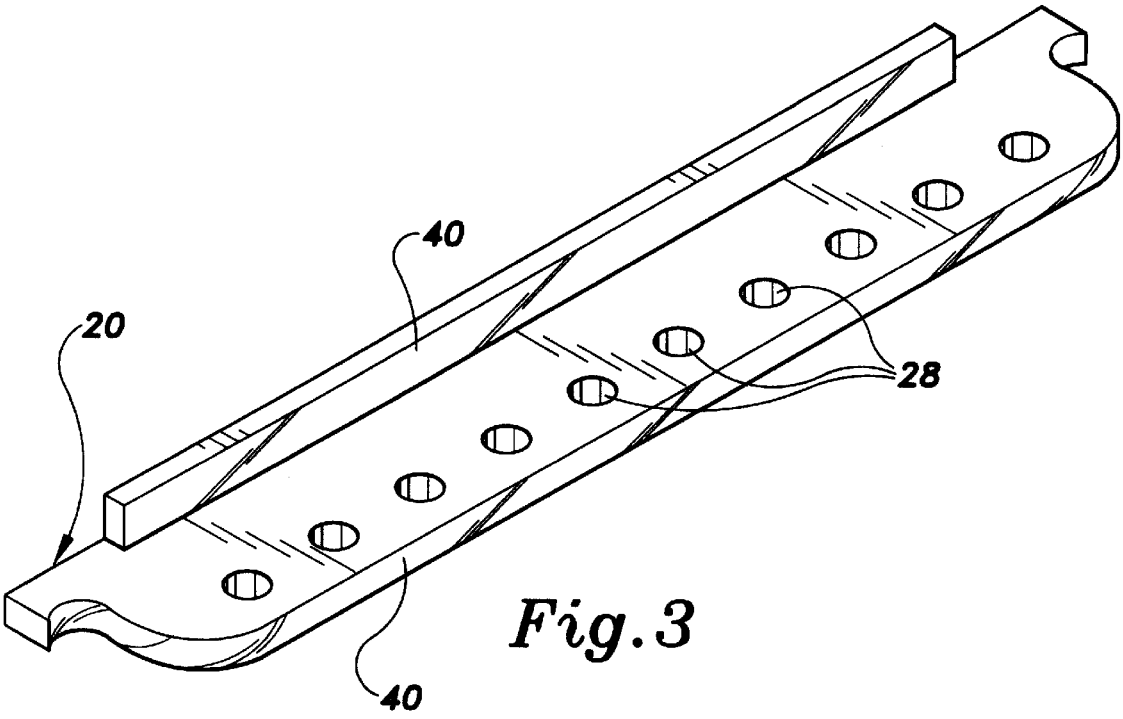
FIG. 3 is a perspective view of the upper shelf of the illuminating cue stick rack.

FIG. 3 is a perspective view of the upper shelf 20 of the illuminating cue stick rack 8 FIG. 3 more clearly shows a plurality of holes bored 28 vertically through the upper shelf. Each of the plurality of holes 28 is sized to permit the passing of the cue end of a cue stick C therethrough. Lights 40 are attached to the front surfaces of the upper shelf 20 for illumination.

Figure 4:
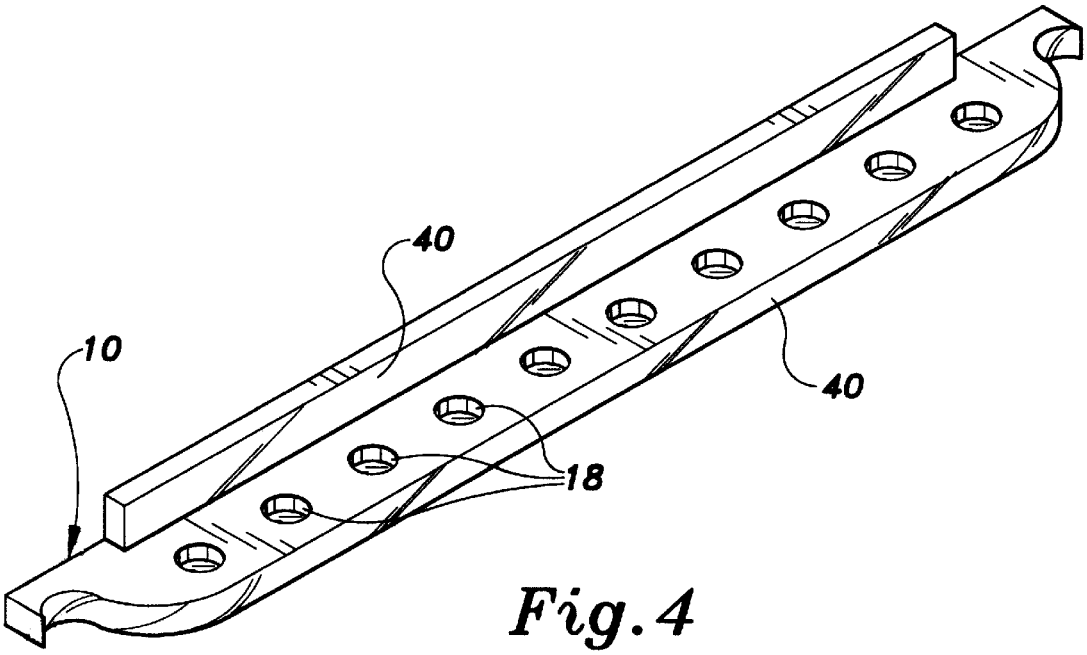
FIG. 4 is a perspective view of the lower base of the illuminating cue stick rack.

FIG. 4 is a perspective view of the lower base of the illuminating cue stick rack 8. FIG. 4 more clearly shows a plurality of recesses 18 provided in the top surface of the lower base 10. Each of the plurality of recesses 18 are sized to support the butt end of a cue stick C. Lights 40 are attached to the front surfaces of the lower base 10 for illumination.

Figure 5:
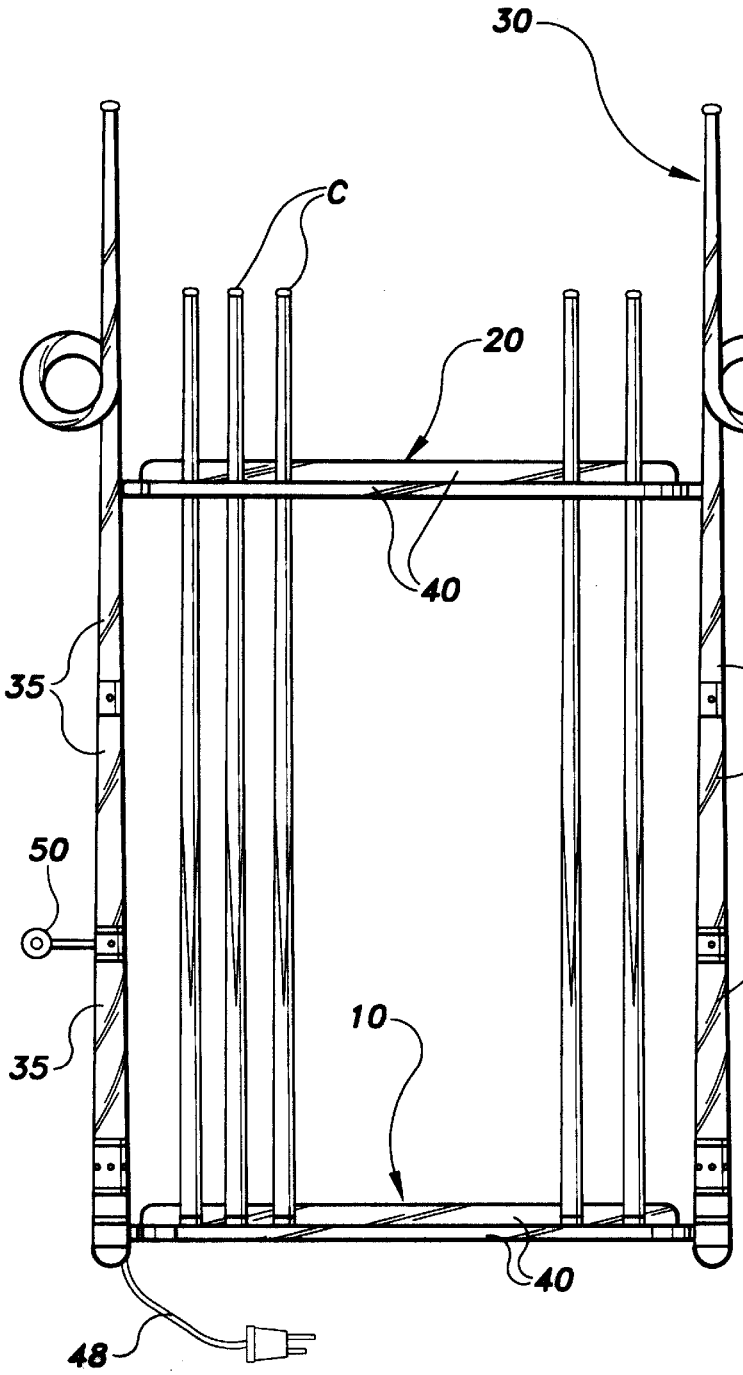
FIG. 5 is a front view of an alternate embodiment of the present invention in which the pair of side supports include decorative spiral loops.
Figure 6:
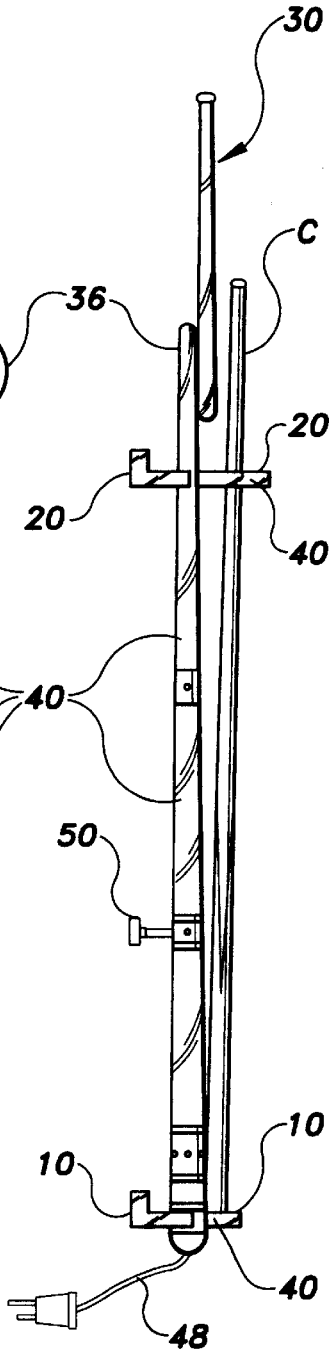
FIG. 6 is a side view of the alternate embodiment depicted in FIG. 5.

FIG. 5 and FIG. 6 depict the front and side views of an alternate embodiment of the present invention. The alternate embodiment includes all of the elements described in FIG. 1 and FIG. 2. Additionally depicted in the alternate embodiment, each of the pair of side supports 30 further possesses a decorative spiral loop 36. The decorative spiral loops 36 are illuminable and are electrically connected to the lighting system.

It is to be understood that the present invention is not limited to the embodiments described above, but encompasses any and all embodiments within the scope of the following claims.

I claim:

1. An illuminating cue stick rack including a rack frame, and further comprising:

a lower base having a top surface with a plurality of recesses, each recess being sized to support a butt end of a cue stick;

an upper shelf having a plurality of holes bored vertically therethrough, each hole being sized to permit the passing of a cue end of a cue stick therethrough;

a pair of side supports attached to the lower base and to the upper shelf to position the holes of the upper shelf in relative alignment with the recesses of the lower base for holding at least one cue stick; and an electric lighting system disposed on the rack frame.

2. The illuminating cue stick rack according to claim 1, further comprising an electric switch to selectively turn the lighting system on and off.

3. The illuminating cue stick rack according to claim 1, wherein each of the pair of side supports further have at least one illuminating portion electrically connected to the lighting system.

4. The illuminating cue stick rack according to claim 1, wherein the pair of side supports are configured in the shape of over-sized cue sticks.

5. The illuminating cue stick rack according to claim 1, wherein each of the pair of side supports is configured in the shape of an over-sized cue stick possessing at least one illuminating portion electrically connected to the lighting system.

6. The illuminating cue stick rack according to claim 1, wherein each of the pair of side supports is configured in the shape of an over-sized cue stick having a decorative spiral loop.

7. The illuminating cue stick rack according to claim 1, wherein each of the pair of side supports is configured in the shape of an over-sized cue stick having a decorative spiral loop and possesses at least one illuminating portion electrically connected to the lighting system.

8. The illuminating cue stick rack according to claim 1, further comprising at least one cue stick, each cue stick having a tip end permanently secured within one of the holes bored through the upper shelf and having a butt end permanently secured within one of the recesses of the lower base.

9. The illuminating cue stick rack according to claim 1, wherein each of the cue sticks have at least one illuminating portion electrically connected to the lighting system.

* * * * *